US005626505A

United States Patent [19]

Cheng

[11] Patent Number: 5,626,505

[45] Date of Patent: May 6, 1997

[54] SPRING-ANIMATED TOY FIGURE

[75] Inventor: Simon K. H. Cheng, Kwun Tong, Hong Kong

[73] Assignee: James Industries, Inc., Hollidaysburg, Pa.

[21] Appl. No.: 597,294

[22] Filed: Feb. 6, 1996

[51] Int. Cl.[6] ..... A63H 11/12

[52] U.S. Cl. ..... 446/278

[58] Field of Search ..... 446/278, 289, 446/290, 294, 317, 320, 368, 380, 379, 376, 382, 486

[56] References Cited

U.S. PATENT DOCUMENTS

| | | | |
|---|---|---|---|
| D. 179,949 | 3/1957 | Malsed | 446/320 X |
| 2,415,012 | 8/1947 | James . | |
| 2,862,330 | 12/1958 | Malsed . | |
| 3,005,286 | 10/1961 | Derham | 446/278 X |
| 4,216,612 | 8/1980 | Erickson et al. | 446/382 X |
| 4,463,514 | 8/1984 | Nagai | 446/294 |
| 4,657,519 | 4/1987 | Kobayashi | 446/376 |
| 4,690,656 | 9/1987 | Friedman et al. | 446/424 X |
| 4,828,532 | 5/1989 | Tarlow et al. | 446/486 |

FOREIGN PATENT DOCUMENTS

| | | | |
|---|---|---|---|
| 792065 | 12/1935 | France | 446/317 |
| 248235 | 5/1948 | Switzerland | 446/382 |
| 966420 | 8/1964 | United Kingdom | 446/379 |

OTHER PUBLICATIONS

Original SLINKY® Dog Pull Toy, copy of box used in sale of product, James Industries Inc., 2 pages.

*Primary Examiner*—Robert A. Hafer
*Assistant Examiner*—D. Neal Muir
*Attorney, Agent, or Firm*—Howson and Howson

[57] ABSTRACT

An articulated spring toy comprising fore and aft body sections connected together by a helical spring. The spring is fastened at opposite ends to the body sections in a manner that conceals the spring ends and provides a permanent connection that resists disconnection in normal usage. Other desirable structural features are also disclosed.

14 Claims, 4 Drawing Sheets

10
12
14
16
18
20
24
52
56
58
60
62
66
70
4
6

10
12
14
16
18
20
22
24
52
58
62

FIG. 4
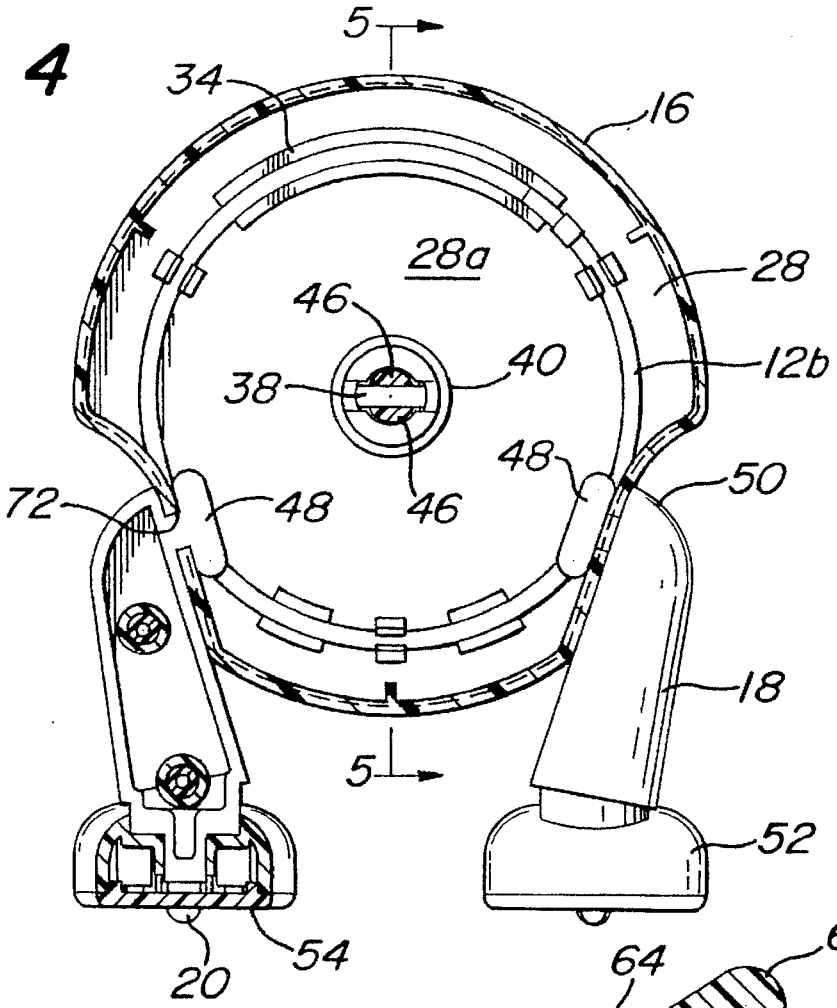
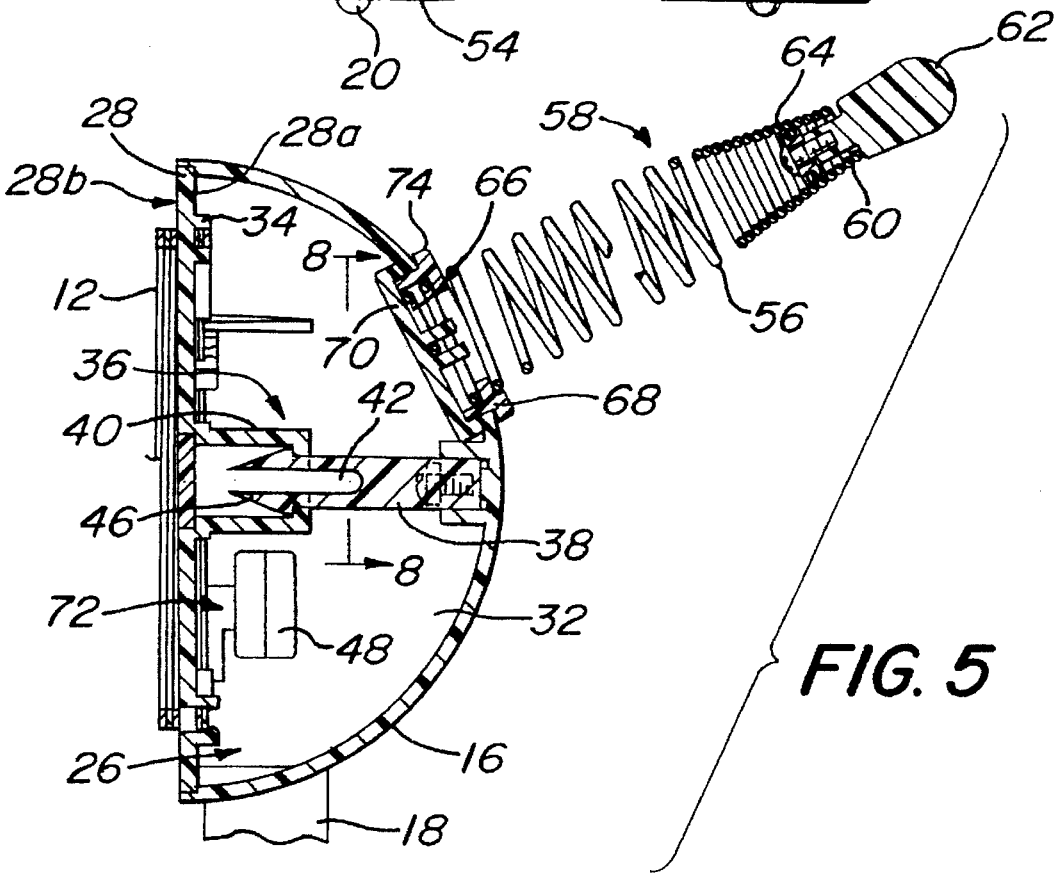
FIG. 5

SPRING-ANIMATED TOY FIGURE

FIELD OF THE INVENTION

The present invention relates to toys, and more particularly, the present invention relates to an articulated toy figure utilizing a walking-type spring toy connected between relatively moveable fore and aft body sections.

BACKGROUND OF THE INVENTION

Several years ago, James Industries, Inc., owner of the present application, made popular an articulated toy which incorporated the famous SLINKY® brand spring toy that it originated. The toy was characterized by fore and aft body sections connected together by a SLINKY®brand spring toy. Both body sections had wheels and a string attached to the fore body section so that, when pulled, the toy would move across the surface with a spring providing both longitudinal expansion and contraction and curvilinear relative movement. The body sections were made of plastic and formed into animate figures, such as a dog, frog, kitten, caterpillar, and inanimate figures such as a train.

In the above-mentioned toy products, opposite ends of the spring were received within recesses of the hollow body sections and were secured simply by means of short flanges engaging the spring coil portions at select peripheral locations. This provided a satisfactory connection; however, increased emphasis on toy safety has generated a need to provide a connection which not only contains the end portions of the spring, but which also provides a connection which resists disconnection in the normal course of usage.

OBJECTIONS OF THE INVENTION

With the foregoing in mind, a primary object of the present invention is to provide an improved articulated spring toy of the type which incorporates a helical spring connecting fore and aft body sections.

It is another object of the present-invention to provide a unique connection of a helical spring toy to fore and aft body sections of an articulated spring toy in such a manner that the sections remain firmly affixed to the spring toy in the normal course of usage.

A further object of the present invention is to provide an articulated spring toy having fore and aft body sections which are connected to the spring toy in such a manner that the end coils of the spring toy are concealed within the body sections.

SUMMARY OF THE INVENTION

More specifically, the present invention provides an improved articulated toy having body sections connected to opposite ends of a walking-type helical spring, such as a SLINKY® brand spring toy. In the toy, each of the body sections has a recess with an opening which receives an end portion of the helical spring. A means is provided for permanently fastening the end portion of the spring in the recess. To this end, a plate is disposed transverse to the coil spring among end portion coils thereof. The plate has a peripheral portion which extends outwardly beyond the periphery of the coil spring and has a notch enabling at least one full end coil to be positioned against the plate on the inside of the body section. The plate extends across the recess to form a closure and thereby capture and contain the end portions of the spring coil in the body section. In a preferred embodiment, the notches are provided in the fore and aft body sections adjacent the recess opening for receiving depending legs mounting wheels. The aft section mounts a helical coil spring having a tip which is secured to a necked-down portion by a fastener disposed therein.

BRIEF DESCRIPTION OF THE DRAWINGS

The foregoing and other objects, features and advantages of the present invention should become apparent from the following description, when taken in conjunction with the accompanying drawings in which:

FIG. 4 is a sectional view taken on line 4—4 of FIG. 1;

FIG. 5 is a sectional view taken on line 5—5 of FIG. 4;

DETAILED DESCRIPTION OF THE PREFERRED EMBODIMENT

Figure 1:
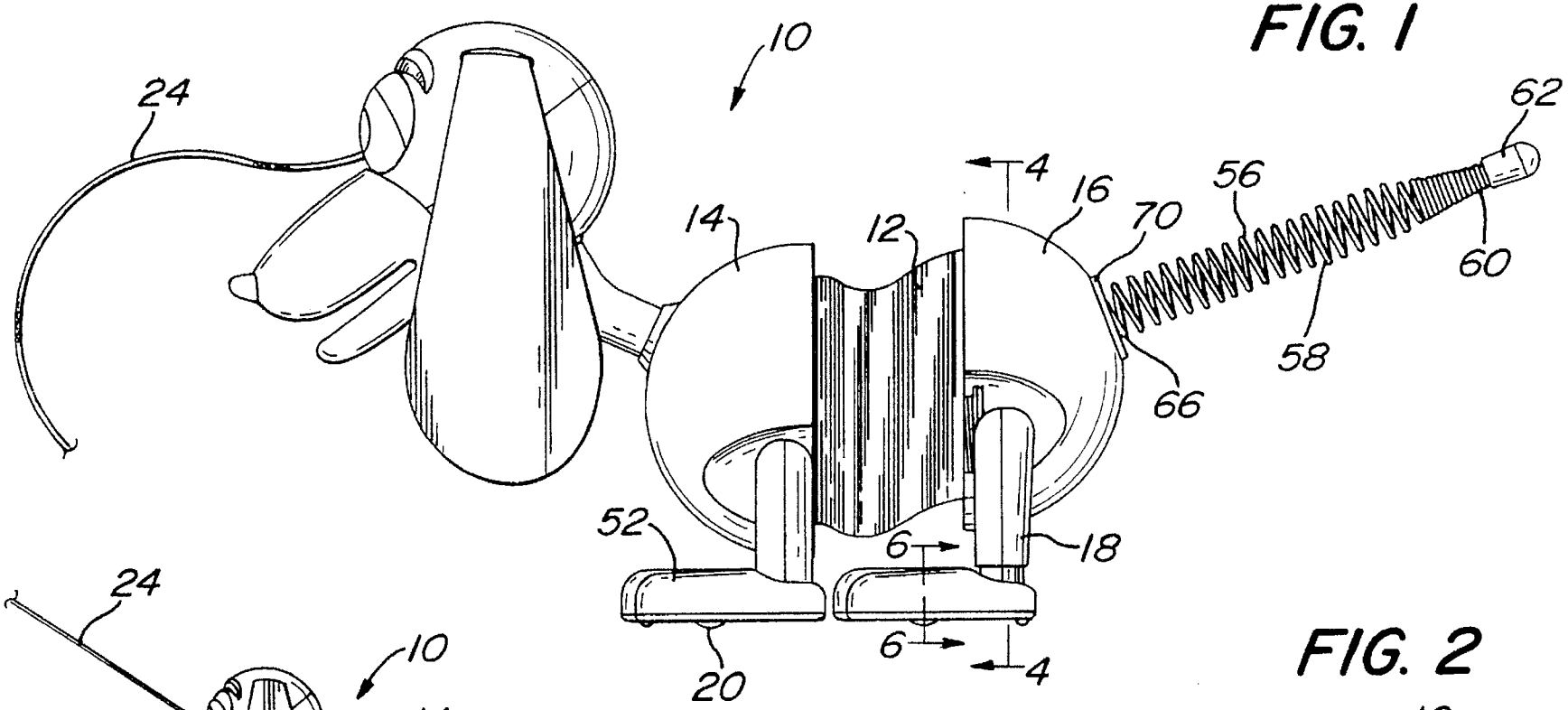
FIG. 1 is a side elevational view of an articulated spring toy embodying the present invention.

Referring now to the drawings, FIG. 1 illustrates an articulated spring toy 10 which embodies the present invention. The spring toy 10 includes a helical coil spring 12, preferably a SLINKY® brand walking spring toy manufactured by James Industries, Inc. of Hollidaysburg, Pa., owner of the present application. The spring 12 is connected to and between fore and aft body sections, and 16, respectively.

Figure 2:
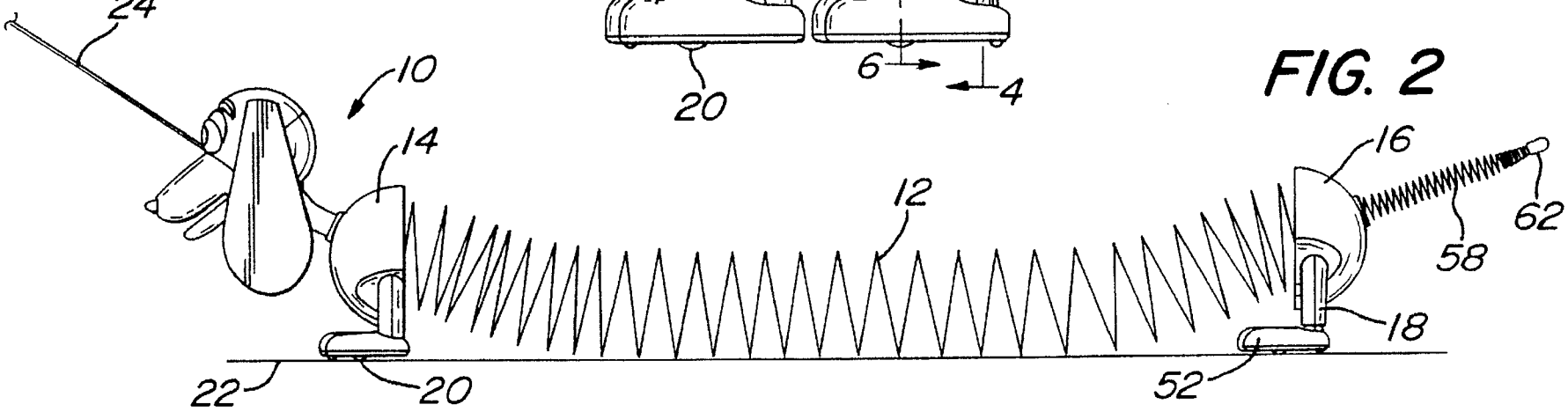
FIG. 2 is a side elevational view in reduced scale, showing the articulated spring toy of FIG. 1 in a longitudinally-extended position.

In the illustrated embodiment, the fore and aft body sections, 14 and 16, and the coil spring 12 cooperate to form a dog figure having depending legs 18 which mount wheels 20 enabling the figure to advance across a horizontal surface 22 when pulled by means of a drawstring 24. As shown in FIG. 2, the spring 12 permits the fore and aft sections 14 and 16 to move longitudinally relative to one another as the spring 12 expands and contracts, and it enables the sections 14 and 16 to pivot relative to one another. The articulated toy 10 described thus far was popular several years ago, and was sold under the trademark SLINKY® Dog, along with other similarly-constructed articulated animate creatures and inanimate figures.

Figure 3:
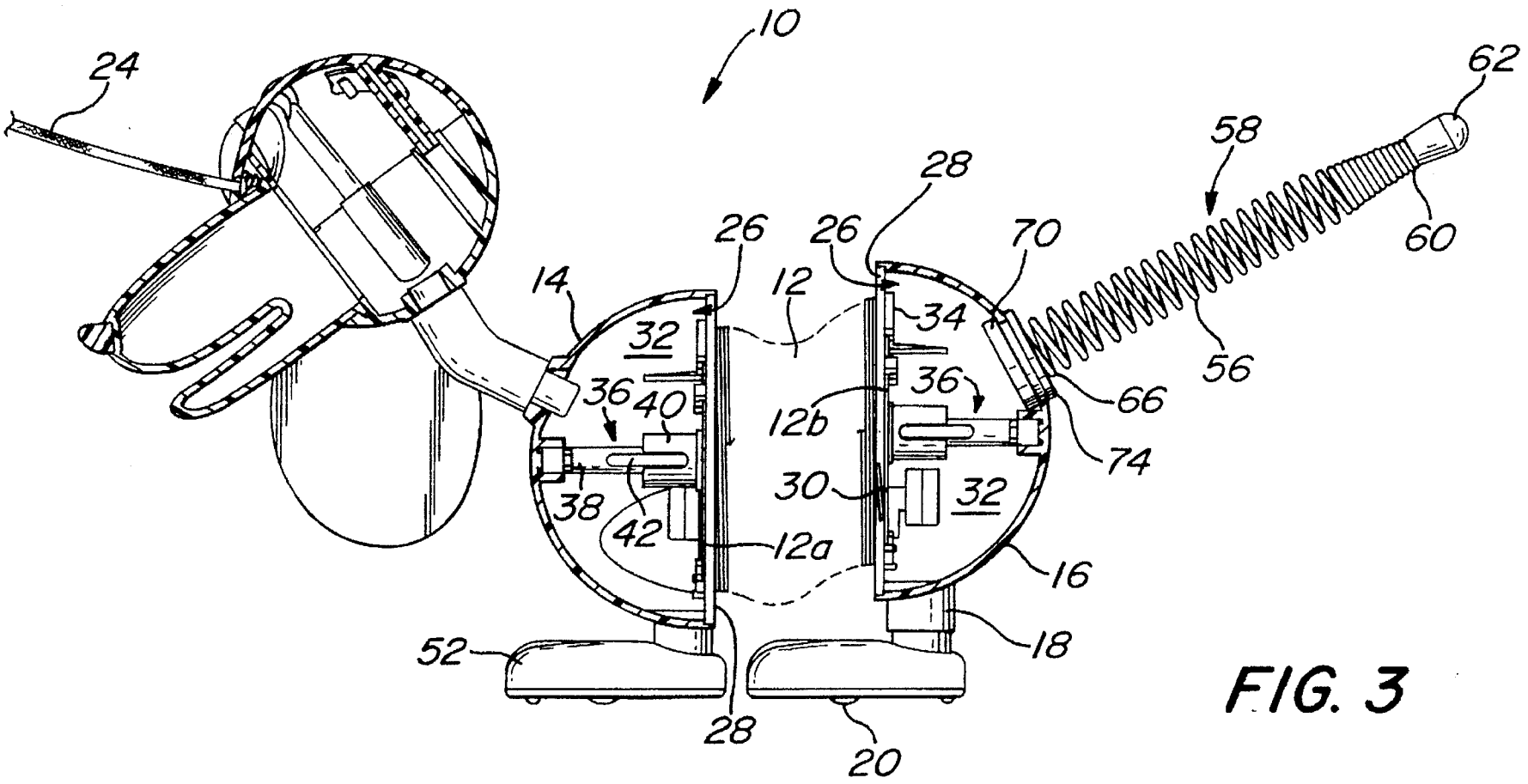
FIG. 3 is a longitudinal sectional view of the articulated spring toy of FIG. 1.

The present invention provides an improved means for fastening the spring coil 12 to the fore and aft body sections 14 and 16 among other improvements. To this end, as best seen in FIG. 3, each body section, such as the aft body section 16, is of hollow molded plastic construction having a recess 32 with an opening 26 greater in diameter then the diameter of the coil spring 12 for receiving an end portion 12*a* or 12*b* of the coil spring 12. A fastener plate 28 is disposed transverse to the longitudinal axis of the spring coil 12 and extends outwardly beyond the periphery of the spring coil 12. The plate 28 has a notch 30 in its periphery for enabling an end coil 12*a* or 12*b* of the spring 12 to be disposed against the inside 28*a* of the plate 28 confronting the body section recess 32. The notch 30 provides a path, or track, through the plate 28 to allow the spring 12 to coil around both sides of the plate 28. The inside 28*a* of the plate 28 is provided with arcuate channels 34 for receiving the spring coil 12 in snap engagement. The opposite outside 28*b* of the plate in the illustrated embodiment is relatively smooth.

The plate 28 is fastened to the aft body section 16 by complementary matingly engageable fasteners 36. In the illustrated embodiment, the complementary fasteners 36 include a slotted male prong 38 carried in the aft body section recess 32 on the longitudinal axis of the coil spring 12 and a female receptacle 40 disposed centrally of the plate 28 for receiving the male prong 38 and forming a locking engagement therewith when the plate 28 is pushed axially toward the recess opening 26. Preferably, the prong 38 has an elongate slot 42 forming a bifurcation with barbs 46 that are biased inwardly during axially engagement and that spring outwardly to lock in place after full engagement has been reached. When fully engaged, the plate 28 forms a closure for the recess opening 26. If desired., suitable permanent adhesive may be applied to the prong 38 or its receptacle 40 prior to assembly in order to further minimize the potential for disconnection in the normal course of usage.

The opposite body portion 14 is similarly connected and need not be discussed in detail.

Figure 7:
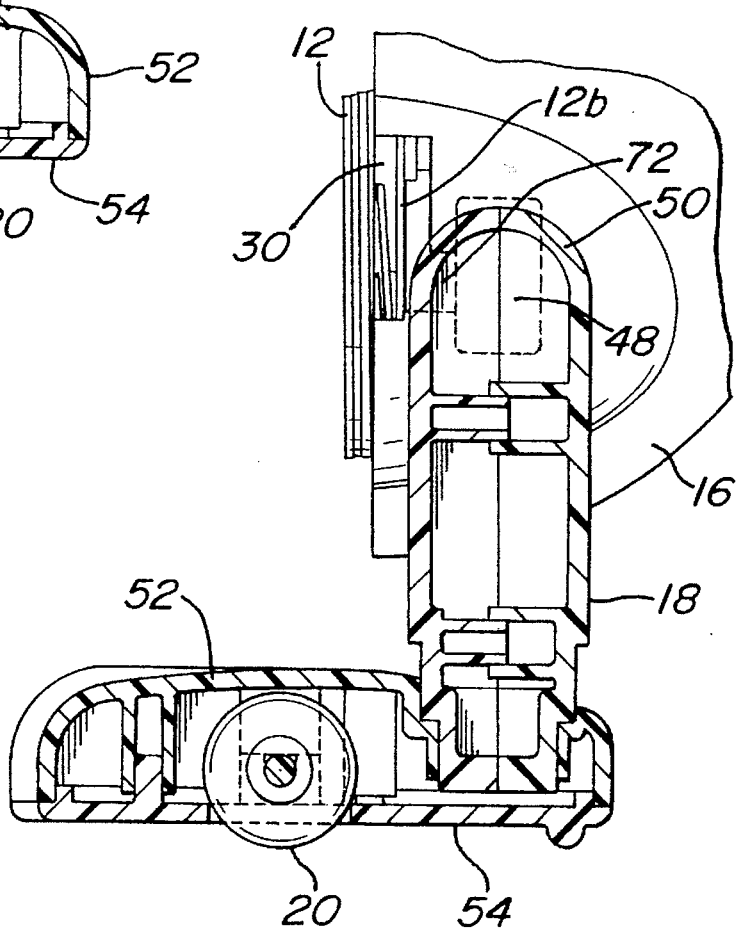
FIG. 7 is an enlarged sectional view taken on line 7—7 of FIG. 6.
Figure 8:
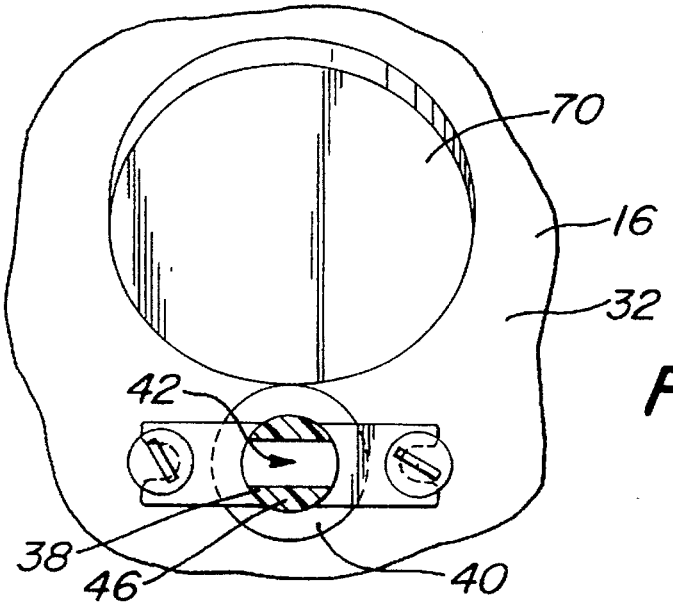
FIG. 8 is an enlarged sectional view taken on line 8—8 of FIG. 5.

Referring to FIGS. 5 and 7, it will be seen that each body section. 14 and 16 has a pair of forwardly-opening notches 72 which receive slotted portions 48 of the upper ends 50 of legs 18 which depend from the body sections. Prior to assembly of the plate 28 of the body section 14 or 16, the slotted leg portions 48 are placed in the notches 30 so that, when the plate 28 is fully engaged, it also serves to secure the legs 18 in place.

Figure 6:
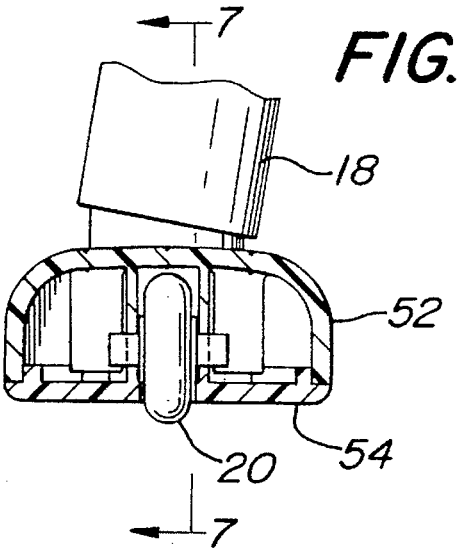
FIG. 6 is an enlarged sectional view taken on line 6—6 of FIG. 1.

As best seen in FIGS. 6 and 7, the bottom 54 of each leg 18 mounts a hollow foot 52. A wheel 20 is provided in the bottom of each foot 52, with the lower periphery of the wheel depending below the bottom 54 of the foot 52 and being exposed to enable the spring toy 10 to be pulled across a horizontal surface 22.

Referring now to FIG. 5, the aft body section 16 mounts a helical spring 56 providing a tail 58 for the dog. The helical spring 56 is open wound, except for its terminal end 60 which is close wound and necked down. A tip 62 is secured to the terminal end 60 of the tail 58 by means of a threaded fastener 64, the head of which is disposed inside the necked down portion of the spring coil 56 and the shank of which threadedly engages in the tip 62. The base 66 of the tail 58 is received within a slot 68 in a slotted shouldered plug 70 on the inside of the aft body section 16 and is glued in position against an exterior collar 74 to resist disconnection.

In view of the foregoing, it should be apparent that the present invention provides an articulated spring toy 10 in which the end spring coils 12*a* and 12*b* are firmly secured to their respective body sections in such a manner that they resist disconnection from the spring 12 and confine the spring ends 12*a* and 12*b*. In the illustrated embodiment, the fore and aft body sections 14 and 16 cooperate with the spring 12 to form a dog; however, it should be apparent that the fore and aft body sections 14 and 16 may include components of other creatures, such as a caterpillar, having a series of axially aligned spring toys connected by intermediate body portions that cooperate to define an elongate creature having multiple body section connected by springs. If desired, inanimate body sections may also be provided, such as portions of cars of a train.

While a preferred embodiment of the present invention has been described in detail, various modifications, alterations, and changes may be made without departing from the spirit and scope of the present invention as defined in the appended claims.

I claim:

1. In an articulated toy figure having fore and aft body sections connected together by a helical spring forming an intermediate section affording relative movement of the body sections when the fore body section is advanced along a surface, the helical spring having fore and aft terminal coil portions and means for attaching said coil portions to the fore and aft body sections respectively, the improvement wherein at least one of the body sections includes a recess, and said attaching means comprises a first fastening member designed as a plate which is secured across said recess forming a closure across said recess and a second fastening member within said closure secured to said first fastening member and telescopically matingly engaged to one of said coil portions to effect a concealed connection of said spring to said body section.

2. A toy figure according to claim 1, wherein said body sections are longitudinally aligned with said spring.

3. A toy figure according to claim 2, wherein said first fastening member includes said plate having peripheral portions disposed in a plane transverse to the spring and extending beyond peripheral portions of the spring coils.

4. A toy figure according to claim 1, wherein said second fastening member has arcuate channels confronting said one body section receiving the spring coil portions inwardly of peripheral portions of the plate.

5. A toy figure according to claim 1, wherein outer surfaces of said fore and aft body sections are in the shape of head and rear sections of a dog.

6. A toy figure according to claim 5, wherein said aft body section mounts a tail, said tail being formed of a second helical spring.

7. A toy figure according to claim 6, wherein said second helical spring has a close-wound, necked-down terminal end portion mounting a tip, and a fastener disposed inside said terminal end portion for securing said tip thereto.

8. A toy figure according to claim 5, wherein each of said fore and aft body sections has a slot opening toward said open end, and including legs having notches received in said slots so that said plate, when installed, also secures said legs in position.

9. A toy figure according to claim 8, include hollow feet mounted at the bottoms of said legs, and wheels mounted in the bottoms of said feet.

10. In an articulated toy having body sections connected to opposite ends of a walking-type helical spring, the improvement wherein each of said body sections has a recess with an opening for receiving an end portion of said helical spring, and including means for permanently fastening said end portion in said recess, said permanent fastening means including a plate disposed transverse to said coil spring among coils thereof adjacent one end thereof, said plate having a peripheral portion extending outwardly beyond a peripheral portion of said coil spring and having a notch for enabling at least one full end coil to be positioned against a side of said plate confronting said recess, and said plate extending across said recess forming a closure within said body section, whereby opposite end -most coils of said spring are concealed within said closure and permanently connected to said body sections.

11. A toy according to claim 10, wherein said fastening means includes complementary aligned fasteners on said plates and said body sections matingly engageable to couple said spring to said body sections.

12. A toy according to claim 11, wherein said body sections include fore and aft animal forms which cooperate with the helical spring to define an animal having an axially expandable and contractable torso, and wheels carried by said body sections to enable said animal form to advance across a surface.

13. A toy according to claim 12, wherein each body section has a notch adjacent its opening, and including a support with a necked-down portion received in said slot and depending from said body section, said plate cooperating to lock said support in position in said body section.

14. In an articulated animal figure toy having fore and aft body sections connected together by a helical spring to form a longitudinally expandable and contractable intermediate body section and wheeled legs depending from said body sections affording translation across a surface, the improvement wherein each of said body sections has a recess with an opening sized to receive an end most coil of said helical spring, a plate extending transverse to said spring adjacent end coils thereof, at least one of said end coils being disposed against said plate on the side thereof facing said recess, and complementary fasteners on said plate and in said body section recess for permanently connecting said plate to said body section with said plate forming a closure for said recess opening and confining said spring end therewithin.

* * * * *